US005758528A

United States Patent [19]

Gallego

[11] Patent Number: 5,758,528

[45] Date of Patent: Jun. 2, 1998

[54] SYSTEM OF LOCKING

[75] Inventor: Luis Valdajos Gallego, Fuenterrabia, Spain

[73] Assignee: Talleres de Escoriaza, S.A., Spain

[21] Appl. No.: 621,132

[22] Filed: Mar. 21, 1996

[30] Foreign Application Priority Data

Mar. 21, 1995 [ES] Spain ..... 9500560

[51] Int. Cl.[6] ..... E05B 25/00

[52] U.S. Cl. ..... 70/385; 70/372; 70/493; 70/374

[58] Field of Search ..... 70/337, 367, DIG. 37, 70/372, 379 A, 384, 374, 375, 385, 493, 406, 379 R, 382, 383

[56] References Cited

U.S. PATENT DOCUMENTS

| | | | |
|---|---|---|---|
| 1,216,859 | 2/1917 | Shaw | 70/379 A |
| 1,233,806 | 7/1917 | Raymond | 70/337 |
| 1,384,022 | 7/1921 | Best | 70/375 |
| 1,679,558 | 8/1928 | Best | 70/406 |
| 2,199,165 | 4/1940 | Smith | 70/372 |
| 2,427,837 | 9/1947 | Connell | 70/385 |
| 2,807,158 | 9/1957 | Best | 70/370 |
| 3,172,284 | 3/1965 | Crandell et al. | 70/383 |
| 3,191,407 | 6/1965 | Spon | 70/383 |
| 3,257,831 | 6/1966 | Schlage | 70/383 |
| 3,439,516 | 4/1969 | Quillen | 70/383 |
| 3,702,553 | 11/1972 | Nolin | 70/385 |
| 4,123,926 | 11/1978 | Elder | 70/375 |
| 4,912,953 | 4/1990 | Wobig | 70/385 |
| 5,513,509 | 5/1996 | Bergen | 70/409 |

FOREIGN PATENT DOCUMENTS

| | | | |
|---|---|---|---|
| 404232 | 10/1924 | Germany | 70/375 |
| 2241452 | 3/1974 | Germany | 70/337 |

*Primary Examiner*—Darnell M. Boucher
*Attorney, Agent, or Firm*—Laff, Whitesel, Conte & Saret, Ltd.

[57] ABSTRACT

The present invention provides a system of locking the type of lock which has a cylinder constituted by a static body or barrel and by a rotatory body or core, equipped with a multiplicity of radial assemblies or key sequences. The lock contains at least one pair of tumblers mounted against a common impeller spring. The lock sequences of which each operate in relation to respective indentations formed by the tooth-like cutting of the active edge of a key blade. The cylinder for six or five key sequences all of which are spring-loaded. The key corresponding to the cylinder and having corresponding indentations. A removable plug or stop which is selectively placed or removed with respect to the opening at back, is situated farther to the rear of the channel for insertion of the key into the rotatable body or core. The position of the removable plug or stop being such as to displace a step or an amplitude of the distance between the axes of two successive key sequences.

12 Claims, 2 Drawing Sheets

SYSTEM OF LOCKING

FIELD OF THE INVENTION

The present invention relates to a cylinder lock and key and more particularly relates to a cylinder lock with at least a lock that has a relatively uncomplicated construction.

BACKGROUND OF THE INVENTION

This type of construction is extensively used for door locks (whether installed in the center of a door knob, or installed independently of the knob or other kind of handle). The locks are operated by means of keys known as "edged" and which have on their blade an active toothed edge, so as to form a succession of indentations which are capable of "keying by engagement" (i.e., of establishing the valid combination for opening), each said indentation operating with respect to a radial combination movement, which latter is constituted by, at least, one pair of tumblers and an impeller spring and which we shall designate as "key sequence" or, simply, as "sequence".

Other conventional designations, to be employed hereinafter, are: "barrel", for the static body (stator), with respect to which the turning of the key is effected; "pipe" for the rotating body (rotor), into which the key is inserted and which, together with the key, rotates within the heart of the barrel; "cylinder", "front", designating the extremity of the cylinder, through which the key is inserted; and "back" at the extremity opposite from the front.

In the field of this invention, it has been traditional to employ the cylinder of five sequences ("cylinder of five"), which operates in conjunction with a corresponding key of five indentations ("key of five").

On the other hand, likewise known are cylinders of six sequences ("cylinders of six"), and their corresponding keys of six indentations ("keys of six"), although they have been employed for more sophisticated locks than the ones that we have in mind. Logically, these cylinders of six provide an additional security, which is inherent in the incorporation of one more sequence and in the considerably greater number of possible combinations.

Within the scope of locks of the type with which we are now concerned, great interest always attaches to an increase of their intrinsic security—all the more so, given the frequency with which they are currently installed and the fact that the demand for them is expressed by the majority of users.

The quickest way, and perhaps the simplest and most economical way, to achieve such an increase of intrinsic security is for the new locks to be provided with cylinders of six sequences, instead of with the conventional cylinders of five.

At the present time, however, even a solution as quick and simple as this one poses important problems involving the lack of a sufficient degree of compatibility and involving duplications of stocks that prove costly to maintain, when it comes to keeping of the production line, in storage and on sale both cylinders "of six" and "of five" key sequences.

SUMMARY OF THE INVENTION

The new system of locking which is herein described offers a highly versatile solution which is going to make possible a full operative compatibility between cylinders of six key sequences and cylinders of five key sequences.

For this purpose, the new system of locking corresponds to a peculiar design which comprises, in particular: a cylinder for six key sequences which are all loaded; a corresponding key with six indentations; and a removable plug or stop which is selectively placed in or removed from and with respect to the rear opening situated closer to the back of the canal for insertion of the key into the core, in keeping with which the position of the removable plug or stop is such as to permit us to displace a step or amplitude of the distance between axes of two successive key sequences.

In accordance with this construction, what is characteristically accomplished is that, said removable plug or stop being operatively installed, and in relation to a corresponding key of six indentations for said cylinder of six sequences, this plug or stop establishes an obstacle against penetration by said key, in such a way that the five key sequences closest to the tip or bit of the key cooperate with the first five places of the cylinder, whereas the sixth key sequence, or that closest to the back of the cylinder, cooperates with respect to the very tip or bit of this key of six indentations, with the first turn of the key being inoperative; this obstacle against penetration is also operative in the case of a conventional key with five indentations, for then it will be observed that these five indentations operate with respect to the five key sequences closest to the front of the cylinder, and that the sixth sequence of the cylinder operates with respect to the very tip or bit of this key with five indentations. The plug or stop being removed, and in relation to a corresponding key of six indentations for said cylinder of six sequences, said key can thus penetrate to its entire extent until establishing the conventional limit of movement in the front of the pipe and causing its six indentations to remain operatively face to face with said six sequences of the cylinder.

In other words, with this ingenious and characteristic new design, what is accomplished is that one and the same lock with a cylinder of six sequences, loaded in all its positions, can be actuated both with a key of six indentations and with a conventional key of five indentations, inasmuch as the arrangement of the removable plug or stop definitely causes the cylinder of six sequences to be converted in such a way as to function as a cylinder of five sequences; and with the additional advantage that this cylinder of six sequences thus adapted, possesses more intrinsic security than a conventional cylinder of five sequences, given that now the key of five indentations operates on the six key sequences of the new cylinder and, therefore, that it has the additional combination capacity that is inherent in the actuation of the tip or bit of the key with respect to the deepest or rearmost sequence of the cylinder. Furthermore, this new cylinder can be actuated in two different degrees of penetration by the key of six indentations; when the plug or stop has been removed, the actuation is that of a key of six indentations in a cylinder of six sequences; and, when the plug or stop is installed, the key does not penetrate completely and it operates just the same as the above-mentioned conventional key of five indentations, with the indentation closest to the handle of the key of six indentations remaining inoperative.

Linking up with this last-mentioned form of operation, the invention also ensures that the aforesaid key of six indentations is fully compatible for functioning with a conventional cylinder of five sequences—whereby the five sequences closest to the tip or bit of the key are engaged, logically, in functioning with only the five sequences of the cylinder of five sequences.

By way of summary, the new system of locking offers great versatility and full compatibility with the systems currently in use, because its key also serves to actuate a conventional cylinder of five sequences and vice-versa; moreover, since the cylinder is able to comport itself both as one of six sequences and as one of five sequences, both of these requirements may be fulfilled by a single cylinder—all of which reduces the size of stock inventories (for both the manufacturer and the seller) and makes it possible to expand the size of the mass production series, thereby reducing the unit cost of that which constitutes the most expensive component of the system.

From the foregoing it is appropriate to deduce a peculiar feature of the new system, which feature, by reason of its great importance, must be explicitly emphasized. What this means is that, in the forms of functioning as cylinders of six sequences and as cylinders of five sequences, there obtains a translation as regards the indentation of the key which acts on a certain sequence of the single cylinder; which is to say that a specific sequence interacts with a sequence in the manner of five sequences, and with the contiguous sequence closer towards the back in the manner of six sequences.

When this is related to the feature whereby the cylinder may be actuated either with a key of six indentations or with a conventional key of five indentations, there arises the advantageous possibility of obtaining an additional function of security, if the cylinder is supplied with a key having each of these numbers of indentations; then, if, on account of loss, distrust, etc., it is wished to eliminate one of these possibilities of actuation, it will suffice to remove the plug or stop so that the key of six indentations will be rendered inoperative by displacement into a place between the indentations and its former sequences, inasmuch as we believe that, with the plug or stop in place, the system was thus prepared so that the key of six indentations might function as a key of five indentations.

Even though this might appear to gainsay the above-mentioned compatibility, such is not absolutely the case—inasmuch as this compatibility is real, considered from the overall standpoint of the system; however, by the very nature of the concept of "key", when reference is made to an actual cylinder, the realization of this compatibility entails the adaptation of the combination ensemble of the six sequences, by replacing the former tumblers with others that are suitable to the new situation of the key; this adaptation is usually made by locksmiths and is only required in the extraordinary circumstances mentioned or when, if a user is faced with the need to incorporate new locks, he were to demand that some or all of such locks be opened by one and the same key or by a certain key.

These and other characteristics of the invention will be evidenced hereinunder.

DETAILED DESCRIPTION OF THE DRAWINGS

In order that the nature of the invention may be better comprehended, in the attached drawings we represent a preferred form of industrial embodiment, which is merely illustrative and not limiting in character.

DETAILED DESCRIPTION OF THE PREFERRED EMBODIMENT

Figure 1:
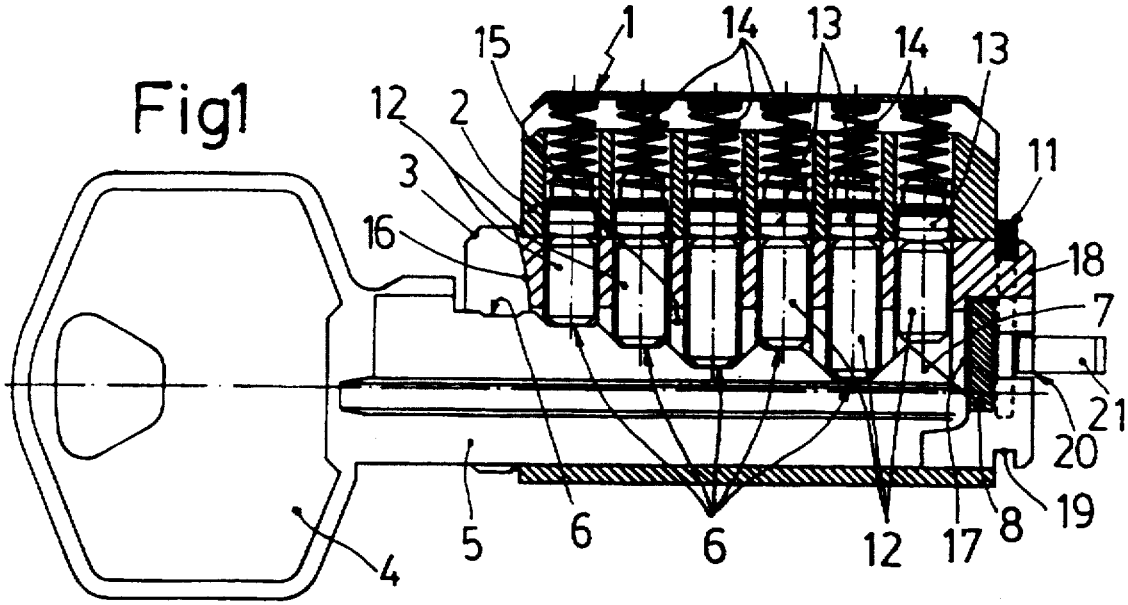
FIG. 1 shows in longitudinal cross-section a lock cylinder according to the invention, which cylinder is provided with an plug or stop plate and activated with a key of six indentations.
Figure 2:
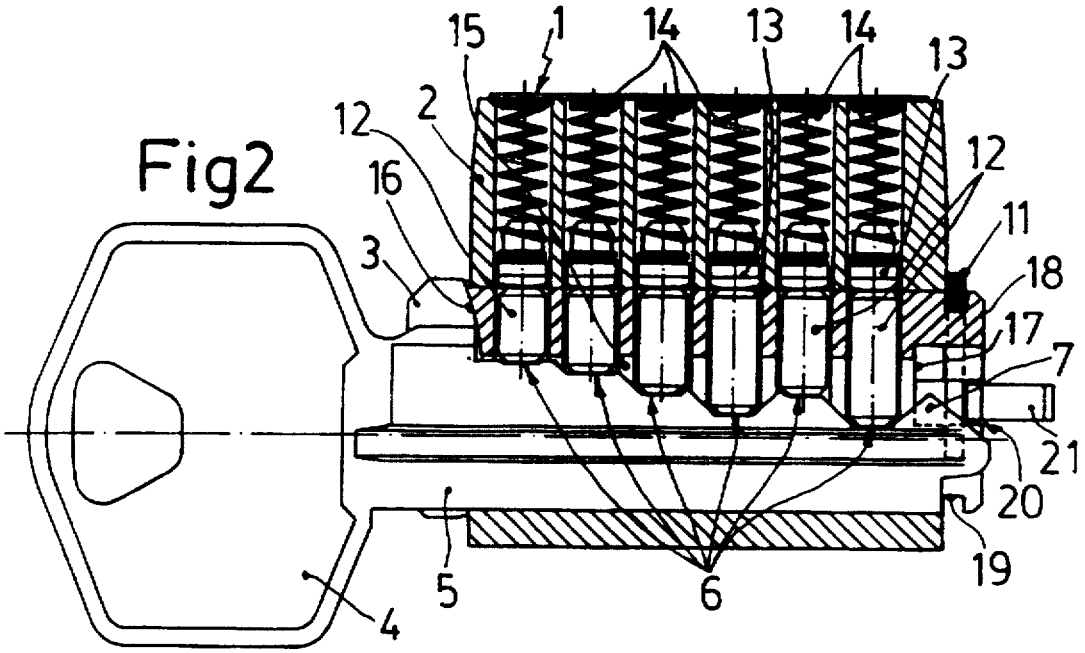
FIG. 2 is similar to FIG. 1, but with the plug or stop plate having been removed.
Figure 4:
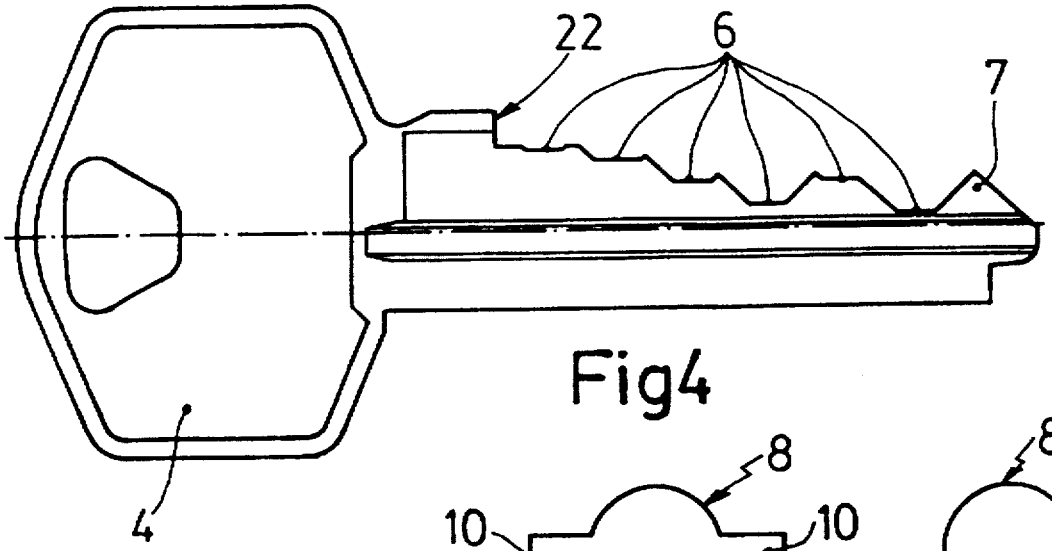
FIG. 4 is a key with six indentations.

FIG. 1 refers to a cylinder lock (1), of the type having a retractable breech, to be installed in the center of knobs and similar tubular conduits and FIG. 2 refers to a cylinder lock (1), of the type having a barrel (2), being compact and without a retractable breech.

Referring to the above drawings and reference numbers, the preferred embodiment of the new locking system for "edged" keys is exemplified in two typical versions of the cylinder—with retractable breech, and compact—inasmuch as this aspect does not affect the object of the invention, but instead renders its applicability more general.

Nor is the invention affected by the fact that all the key sequences may be constituted by a tumbler (12) against the indentation (6) of the blade (5) of the key (4) and a tumbler (13) against the spring (14); it would be the same if intermediate tumblers were to exist, for example, for training purposes.

Figure 3:
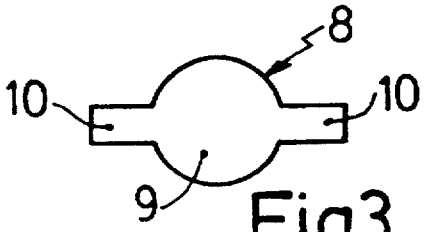
FIG. 3 shows the plug or stop plate as viewed from the front.
Figure 3A:
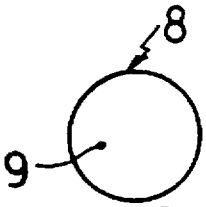
FIG. 3A shows an elective construction of the stop plate.
Figure 5:
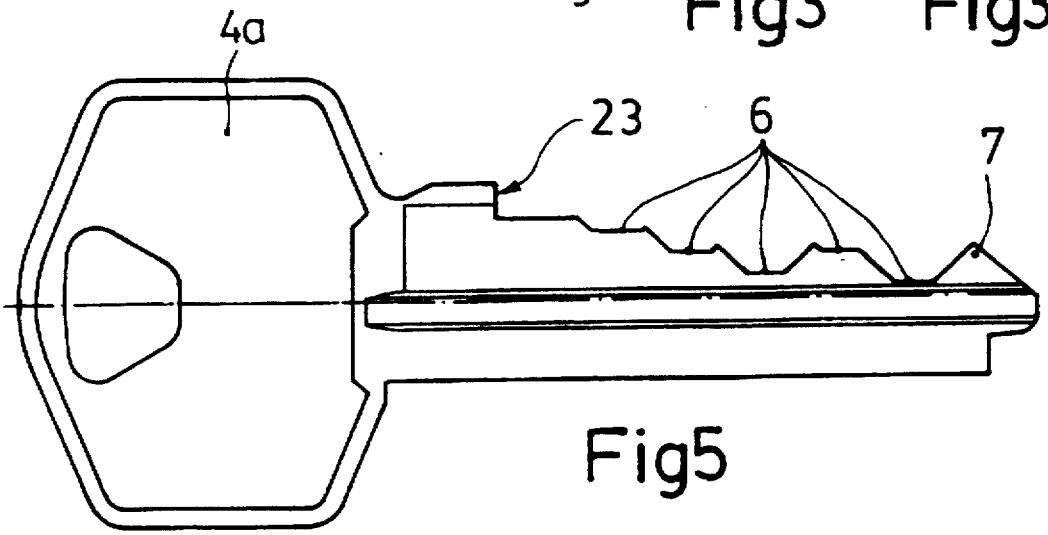
FIG. 5 is a key (4*a*) with five indentations.

The particular conditions of the invention are that the cylinder (1) is to be one of six sequences (12-13-14), all of them spring-loaded, and that, in addition, there is to exist the removable plug or stop plate (8) which is intended to be situated in the space that, in all conventional rotating cylinder bodies or cores (3), will be found between the opening (17) at the back of the channel (15) for key and the annular channel (19), in which latter there is placed the washer-clip (11) for the axial immobilization of this cylinder body or core (3) in relation to the barrel (2); viewed from the front, this space is circular and is prolonged up to the periphery of the cylinder body or core (3), in accordance with the diametrically opposed expansions which are produced by the intersection with the likewise conventional diametrically extending notch (20) which is designed to accommodate the rotatory-dragging bit (21), and that, from the end-surface (18) at the back of the cylinder body or core (3), this notch (20) extends axially as far as the plane onto which said opening (17) at the back of the channel (15) for key emerges; and thus, the plug or stop plate (8) is preferably formed (FIG. 3) by a circular core (9) which is the part that causes the obturation and from which arise the diametrically opposed lugs (10), with respect to which latter said washer-clip (11) performs its retaining function via a simple cylindrical core (9).

When the plug or stop plate (8) is set in place (FIG. 1), a key (4) of six indentations would not penetrate fully and would act by operating with its tip or bit (7) in relation to the deepest sequence (12-13-14) of the cylinder (1), whereas the remaining sequences (12-13-14) would only do so in relation to the five indentations (6) closest to said tip or bit (7), while the sixth indentation (6) remains inoperative by reason of its being beyond the front (16) of the cylinder body or core (3). This same actuation can be accomplished by a conventional key (4*a*) of five indentations, and, in doing so, its usual terminal stop (23) would be inoperative when the terminal stop is reached at the plug or stop plate (8) and with the particular feature that the key (4*a*) with five indentations would act on six sequences and would, for this reason, make for greater intrinsic security than would be true in its cylinder of five sequences. And vice-versa, this key (4) with four indentations can act upon a conventional cylinder of five sequences while remaining in the same degree of incomplete penetration.

When the plug or stop plate (8) is removed (FIG. 2), the key (4) with six indentations can now penetrate entirely until abutting with its terminal stop against the front (16) of the cylinder body or core (3) and thus rendering operative all its indentations (6) with their respective sequences (12-13-14).

The nature of the present invention having been sufficiently described, as well as its industrial embodiment, it is only appropriate to add that, in its overall assembly and in its constituent parts, it is possible to introduce changes of form, material and arrangement within the scope of the invention, provided that such changes do not distort its basis.

I claim:

1. An improved cylinder lock having a rotating cylinder, said rotating cylinder having a key slot with a key entrance end and an opposite end and with said key slot extending from said key entrance end to said opposite end, a plurality of radial key sequence assemblies mounted in said cylinder, each said key sequence assembly having a spring loaded tumbler adapted to form a key sequence with a key step formed on a key having a plurality of key steps, said key slot having a removable plug, said removable plug having a width equal to one of said key steps, wherein when a key is placed in an operating position in said cylinder and said removable plug is removed from said slot, a key bit extends beyond said tumblers and enters into said slot with each of said tumblers engaging a key step on said key, and wherein when said removable plug is removably mounted in said slot, and said key is placed in an operating position in said cylinder a key entrance end of said key bit abuts said removable plug and a tumbler engages said key bit.

2. The improved cylinder lock of claim 1 having six key sequence assemblies.

3. The improved lock of claim 2 wherein said key is a flat key which has said key steps on a top edge and said key bit is a raised portion on said top edge adjacent to said key entrance end.

4. The improved cylinder lock of claim 1 wherein said removable plug has a central core with diametrically opposed lugs.

5. An improved cylinder lock assembly having, a rotating cylinder, said rotating cylinder having a cylinder key entrance end and an opposite end with a key slot extending from said key entrance end to said opposite end, a plurality of radial key sequence assemblies mounted in said cylinder, each said key sequence assembly having a spring loaded tumbler, a key having a plurality of key steps, each key step being adapted to form a key sequence with said tumbler, said key having a key entrance end with a key bit adjacent said key entrance end, said slot having a removable plug, a removable plug being sized to be removably held in said slot, said plug having a width equal to one key step, wherein when said plug is removed from said slot, said key bit enters and extends into said slot and, each of said tumblers engaging a key step on said key, and when said removable plug is removably mounted in said slot and said key is placed in operating position in said cylinder, said key entrance end abuts said removable plug and a tumbler engages said key tip bit whereby one key blank may serve a plurality of types of locks having different numbers of sequence assemblies.

6. The improved lock assembly of claim 5 having six key sequence assemblies.

7. The improved lock assembly of claim 5 wherein said key slot is sized to receive a flat key which has said key steps on a top edge and said key tip is a raised portion on said top edge adjacent to said key entrance end.

8. The improved lock assembly of claim 6 wherein said key channel is sized to receive a flat key which has said key steps on a top edge and said key tip is a raised portion on said top edge adjacent to said key entrance end.

9. A The improved lock assembly of claim 5 wherein said removable plug is cylindrical.

10. The improved lock assembly of claim 8 wherein said removable plug is cylindrical.

11. The improved lock assembly of claim 5 wherein said removable plug has a central core with diametrically opposed lugs.

12. The improved lock assembly of claim 8 wherein said removable plug has a central core with diametrically opposed lugs.

* * * * *